United States Patent [19]

Sims et al.

[11] 4,113,261

[45] Sep. 12, 1978

[54] JAW BREAKER GAME

[75] Inventors: Anson Sims, Northridge; Lawrence T. Jones, Playa Del Rey, both of Calif.

[73] Assignee: Aurora Products Corporation, West Hempstead, N.Y.

[21] Appl. No.: 723,815

[22] Filed: Sep. 16, 1976

[51] Int. Cl.[2] ..... A63F 3/04

[52] U.S. Cl. ..... 273/249; 46/123; 46/141; 273/287

[58] Field of Search ..... 46/118, 119, 175, 194, 46/123, 141; 273/1, 134, 251, 287, 249

[56] References Cited

U.S. PATENT DOCUMENTS

| | | | |
|---|---|---|---|
| 1,656,943 | 1/1928 | Firestone | 273/134 B |
| 3,298,692 | 1/1967 | Glass et al. | 273/134 B |
| 3,861,684 | 1/1975 | Gastin et al. | 273/134 E X |
| 3,994,492 | 11/1976 | Breslow | 273/1 R |

FOREIGN PATENT DOCUMENTS

| | | | |
|---|---|---|---|
| 2,262,146 | 7/1973 | Fed. Rep. of Germany | 273/1 R |

*Primary Examiner*—Anton O. Oechsle
*Attorney, Agent, or Firm*—Jackson & Jones

[57] ABSTRACT

A game is provided in which tokens are moved according to the throw of a die through a number of obstacles on a path from the point of a shipwreck to shore. Adjacent the path of travel is a three dimensional fish whose jaws may be manually moved toward a closed position by rotating its dorsal fin. Playing with the game, a balloon is placed in the fish's jaws and players are required to rotate the fin when their tokens land on particular game board spaces. When the balloon bursts, the player who burst it is penalized.

12 Claims, 5 Drawing Figures

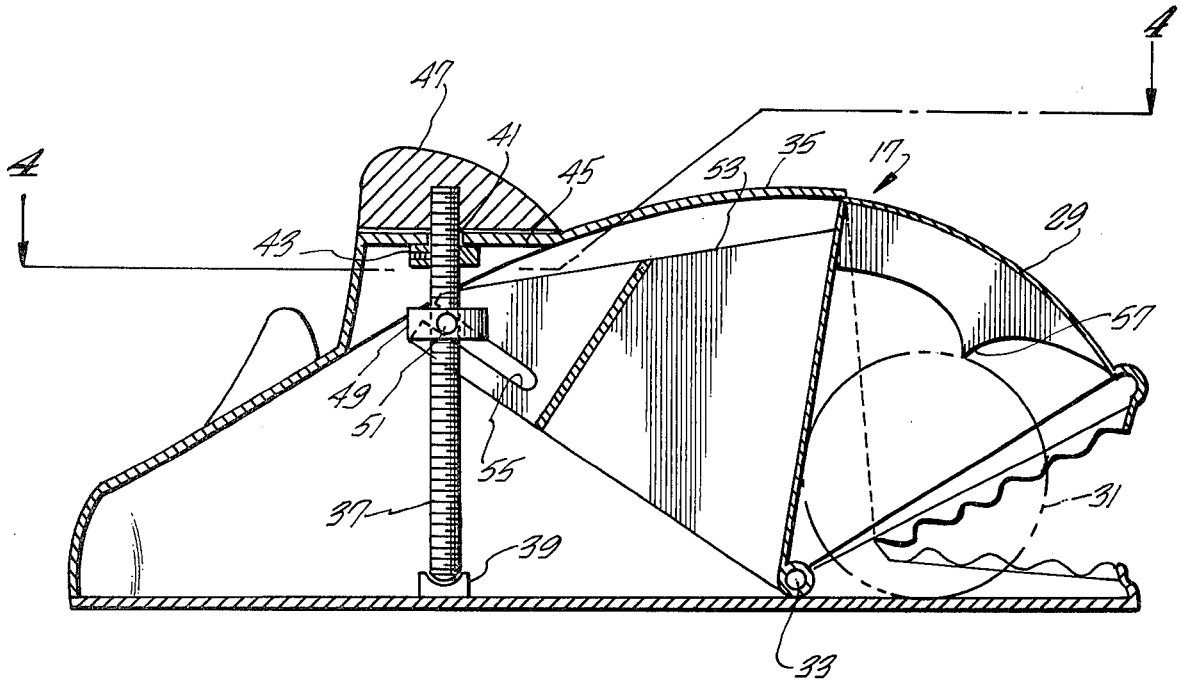
FIG. 3
FIG. 4
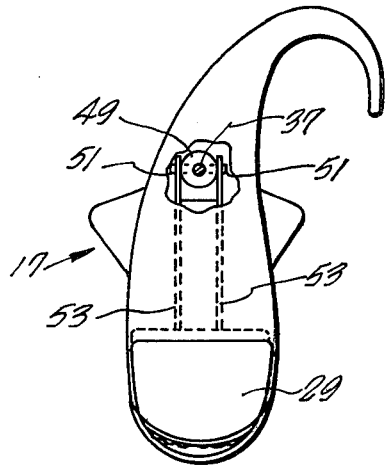
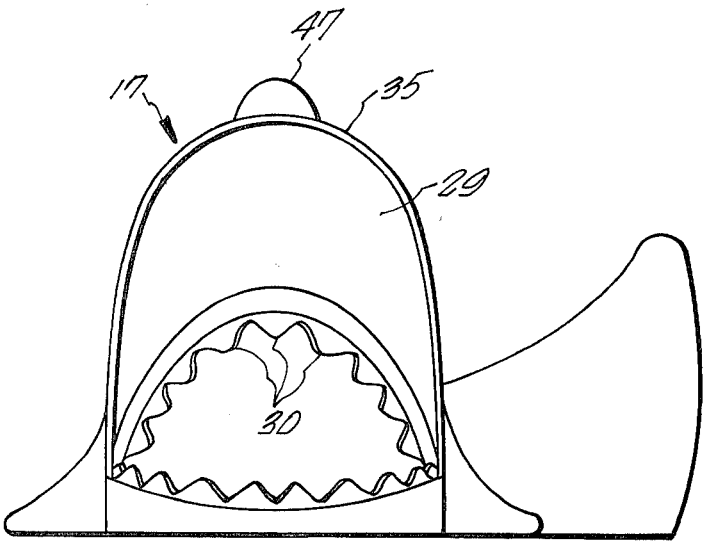
FIG. 5

JAW BREAKER GAME

BACKGROUND OF THE INVENTION

The subject invention relates to games and more particularly to a game employing a two-dimensional game board in conjunction with a three-dimensional animated object. The subject game simulates a float to shore from a shipwreck in which numerous obstacles are encountered, one of which is an animated fish.

Prior art games are well-known in which tokens are advanced on a two-dimensional game board, in accordance with the throw of a die or pair of dice. However, none of these games have simulated an imaginary shipwreck and escape to shore. Neither have they involved the cooperation in such a game of an animated, threatening fish.

SUMMARY OF THE INVENTION

It is therefore an object of the invention to provide a game simulating a shipwreck and escape to shore.

It is an additional object of the invention to provide such a game in which an animated fish toy cooperates.

These and other objects and advantages of the invention are obtained using a game board which contains various paths from the point of a shipwreck to the shoreline. Players move tokens from point to point on the paths by means of the throw of a die. Interposed between the shipwreck and shore is a three-dimensional fish having its mouth movable toward a closed position in increments and having a balloon placed in its mouth. Upon landing on certain designated points along the path from shipwreck to shore, a player must move the fish's jaw toward the closed position a number of increments. The player who is actuating the fish's jaw at the moment the balloon breaks is penalized.

BRIEF DESCRIPTION OF THE DRAWINGS

The preferred embodiment and best mode contemplated for practicing the just described invention will now be described in detail in conjunction with the drawings of which:

FIG. 3 is a side sectional view of the fish toy illustrating the jaw actuating mechanism.

FIG. 4 illustrates a top view depicting the dorsal fin actuator in cutaway.

FIG. 5 illustrates a front view of the fish toy of the preferred embodiment of the invention.

DETAILED DESCRIPTION OF THE PREFERRED EMBODIMENT

Figure 1:
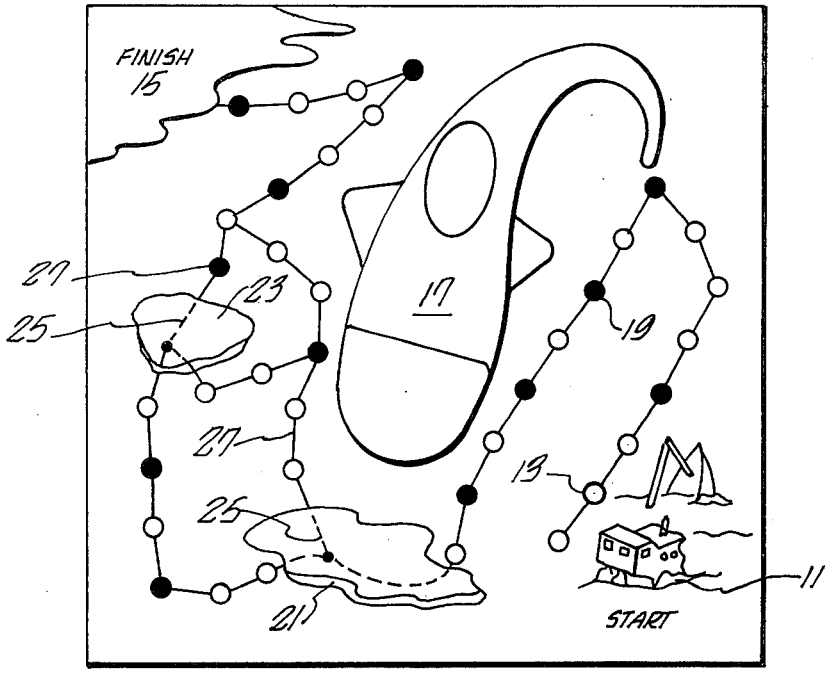
FIG. 1 is a schematic diagram of the game board of the preferred embodiment of the invention.

The game board of the preferred embodiment of the invention is illustrated in FIG. 1. The path along which tokens are advanced on the game board proceeds from the point of a shipwreck 11 along a number of spaces 13, 19.

The game board path leads across two islands 21, 23. At each island 21, 23 there is a point 25 at which a short cut 27 may be taken if a proper die throw occurs. Under the preferred rules, a player must first land on the island in order to have the option to take the short cut. The player must then indicate before his next die throw whether he wishes to take the short cut. A player who has opted to attempt taking the short cut cannot move off the island if he rolls a particular number, for example 2, 4, or 6. However, if the player opting to attempt the short cut rolls a 1, 3, or 5 he may take the short cut and move off the island. If a player is forced to remain on the island because of the number rolled, he again decides on the next turn whether or not to opt to attempt the short cut. The player to reach shore first is the winner.

Interposed between the most direct path from the shipwreck 11 to the shore or finish line 15 is a three dimensional fish 17. The fish 17 has a balloon placed in its jaws, which may be incrementally closed by turning the fish's dorsal fin, as will be later detailed. Any time a player's token lands on a dark colored space 19, that player is required to turn the dorsal fin of the fish 17 a number of times equal to the amount showing on the face of the die he just cast. If the balloon should burst during any of these turns of the dorsal fin, the player is required to go back a particular number of spaces or to the start.

Imaginarily, the lusty appetite of the fish 17 is placed at bay by the balloon in his mouth. When the balloon is burst, he chases the player who burst the balloon back a certain number of spaces or to the start. Each succeeding player that twists the fish's fin runs a greater and greater risk of bursting the balloon, providing an added element of suspense and interest.

Figure 2:
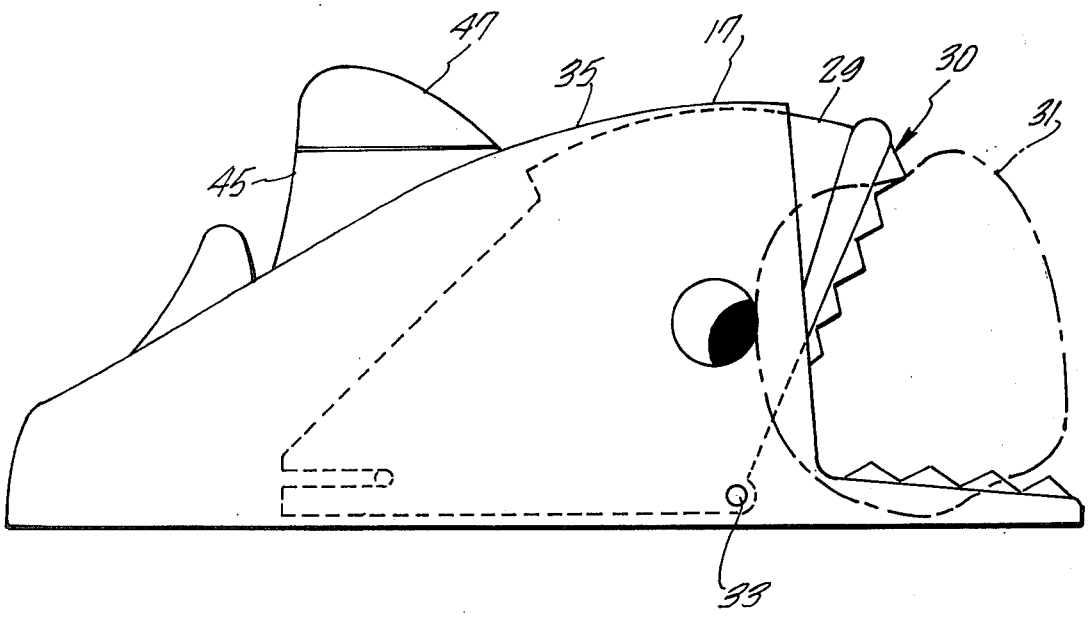
FIG. 2 is a side view of the fish toy used in conjunction with the game board of the preferred embodiment of the invention.

The particular structure of the suspense-providing fish is shown in more detail in FIGS. 2 through 5. FIG. 2 shows the fish 17 with its jaw 29 in an open position, holding a balloon 31. The jaw 29 is pivoted at a point 33 and is of a dimension slightly smaller than that of the fish body 35, such that the jaw 29 may be pivoted about the point 33 to open and close. The jaw is actuated by rotating the upper section 47 of the fish's dorsal fin with respect to the lower dorsal fin section 45.

The opening and closing of the jaw 29 is controlled by a threaded actuator assembly illustrated in more detail in FIG. 3. The acutator includes a threaded vertical rod 37, which is pivotally mounted in a bearing 39 on the interior ventral side of the fish body 35. At the dorsal side of the body 35, a threaded rod 37 protrudes through an opening 41 in the lower dorsal fin section 45. The threaded rod 37 has a collar 43 rigidly attached thereto just below the surface of the dorsal fin lower section 45 to prevent the rod 37 from riding up through the opening 41. The top section of the dorsal fin 47 is rigidly attached to the rod 37 such that the rod 37 turns when the top dorsal fin section 47 is rotated.

Riding on the threaded shaft 37 is a threaded annular disk 49 having two pins 51 arranged on an axis perpendicular to that of the threaded rod 37. The pins 51 are prevented from rotating by respective slots 55 in respective interconnecting members 53. Therefore, when the top dorsal fin section 47 is rotated, the disk 49 will move up or down the rod 37 depending upon the direction of rotation of the dorsal fin upper section 47.

The up or down motion of the disk 49 is then converted to opening or closing of the jaw member 29 through the pair of substantially triangular interconnecting members 53. As shown in FIG. 4, each of the members 53 is connected to the jaw member 29 and therefore pivots about the point 33. In addition, each interconnecting member 53 has a linear slot 55 which accomodates one of the pins 51 mounted on the disk 49. The cooperation between the slots 55 and the pins 51 enables the vertical linear motion of the pins 51 and converts this motion into rotary motion of the interconnecting members 53 about the pivot point 33, thereby moving the jaw member 29 toward an open or closed position.

As further illustrated in FIG. 3, the jaw member 29 has a point 57 on the interior thereof. This point is positioned such that the balloon 31 is burst when the jaw 29 has moved into a desired degree of closing. Alternatively the teeth 30 can actually be ultilized to burst the balloon.

In summary, the fish operates in conjunction with the game as follows. The dorsal fin 47 is first turned to open the fish jaw 29 if it is already not open. A balloon 31 is then placed within the open jaws. As each player lands upon a colored space 19 on the game board, the dorsal fin 47 is turned a particular number of times to incrementally close the fish jaw 29. After a number of turns, the point 57 of the fish jaw 29 will burst the balloon 31 and the player will be penalized accordingly. The number of turns necessary to burst the balloon will of course vary with the strength and degree of inflation of the balloon used.

As may be appreciated, the subject invention provides a game simulating an imaginary shipwreck with an added element of suspense being provided by the cooperating fish toy. As may be apparent, many modifications may be made in the preferred embodiment of the invention just described without departing from the scope and spirit thereof. Therefore, it is to be understood that, within the scope of the appended claims, the invention may be practiced other than as specifically described above.

What is claimed is:

1. A game including a game board comprising:

at least one game token;

a path of incremental progress on said game board from a point of shipwreck to shore;

means for randomly determining the amount of incremental advance of said token along said path;

a three-dimensional toy positionable on said game board, said toy including jaw means capable of receiving an inflated balloon and movable toward a closed position to break said balloon and means for manually incrementally moving said jaw means toward a closed position, and means associated with at least one portion of said path for directing a player to operate said jaw moving means to incrementally move said jaw means toward a closed position if said token lands on said portion.

2. The game of claim 1 wherein said toy is a replica of a fish.

3. The game of claim 2 wherein said jaw means comprises a jaw member pivotally mounted to the body of said fish.

4. The game of claim 3 wherein said means for manually incrementally closing said jaw means comprises:

a rotatable fin on said fish body; and means for converting rotation of said fin into movement of said jaw member.

5. The game of claim 1 wherein said game board includes shortcut paths at first and second islands.

6. The toy of claim 1 wherein said jaw means comprises a pivotable upper jaw member complementary to said body and pivotally mounted to said body such that said jaw member may be pivoted into the interior of said body.

7. A method of playing a game involving a plurality of tokens, each under control of a respective player and a game board having a path having first spaces and at least one second space and a toy including means adjustable in increments for bursting a balloon after a quantity of incremental adjustments, said method including the steps of:

advancing each said token under control of its respective player along said path in response to an arbitrarily determined number;

adjusting said balloon bursting toy a number of increments if a token lands on said at least one second space; and exacting a penalty against the token landing on said at least one second space if said balloon bursts upon said adjusting.

8. The method of claim 7 wherein said toy is a fish replica and said balloon is burst by the jaws of said fish.

9. The method of claim 7 wherein said arbitrarily determined number is fixed by the throw of at least one die and wherein said number of increments equals said arbitrarily determined number.

10. The method of claim 7 wherein said path simulates an escape from shipwreck to shore.

11. The method of claim 10 wherein said path further crosses an island wherein a shortcut may be attempted.

12. The method of claim 11 wherein attempting said shortcut comprises the steps of:

declaring an election to attempt said shortcut;

ascertaining said arbitrarily determined number;

taking said shortcut if said arbitrarily determined number has a first predetermined value; and remaining on said island if said arbitrarily determined number has a second predetermined value.

* * * * *